US007415959B2

(12) United States Patent
Scharp

(10) Patent No.: US 7,415,959 B2
(45) Date of Patent: Aug. 26, 2008

(54) COOLING CHANNEL COVER FOR A PISTON OF AN INTERNAL COMBUSTION ENGINE

(75) Inventor: Rainer Scharp, Vaihingen (DE)

(73) Assignee: Mahle GmbH, Stuttgart (DE)

( * ) Notice: Subject to any disclaimer, the term of this patent is extended or adjusted under 35 U.S.C. 154(b) by 165 days.

(21) Appl. No.: 11/578,876

(22) PCT Filed: Apr. 19, 2005

(86) PCT No.: PCT/DE2005/000717

§ 371 (c)(1),
(2), (4) Date: Nov. 13, 2006

(87) PCT Pub. No.: WO2005/103473

PCT Pub. Date: Nov. 3, 2005

(65) Prior Publication Data

US 2007/0209614 A1 Sep. 13, 2007

(30) Foreign Application Priority Data

Apr. 20, 2004 (DE) ..... 10 2004 019 011

(51) Int. Cl.
*F01P 1/04* (2006.01)

(52) U.S. Cl. ..... 123/193.6

(58) Field of Classification Search ..... 123/193.6, 123/41.35; 29/888.04; 92/186
See application file for complete search history.

(56) References Cited

U.S. PATENT DOCUMENTS

| | | | | |
|---|---|---|---|---|
| 5,207,147 | A | 5/1993 | Leites et al. | |
| 5,261,363 | A | 11/1993 | Kemnitz | |
| 5,357,920 | A | 10/1994 | Kemnitz et al. | |
| 5,546,896 | A | 8/1996 | Zaiser | |
| 5,778,533 | A * | 7/1998 | Kemnitz | 29/888.049 |
| 6,532,913 | B1 | 3/2003 | Opris | |
| 6,647,861 | B1 * | 11/2003 | Jacobi et al. | 92/186 |
| 6,659,062 | B1 * | 12/2003 | Issler | 123/193.6 |
| 6,701,875 | B2 * | 3/2004 | Weng et al. | 123/41.35 |
| 6,722,263 | B2 * | 4/2004 | Keller et al. | 92/186 |
| 6,789,460 | B2 * | 9/2004 | Kohnert | 92/186 |
| 6,938,604 | B2 * | 9/2005 | Gabriel et al. | 123/193.6 |
| 7,131,418 | B2 * | 11/2006 | Wieland | 123/193.6 |
| 2004/0055460 | A1 | 3/2004 | Kohnert | |

FOREIGN PATENT DOCUMENTS

| | | |
|---|---|---|
| DE | 252 638 | 12/1987 |
| DE | 41 34 529 | 5/1992 |
| DE | 40 39 751 | 6/1992 |
| DE | 42 08 037 | 9/1993 |
| DE | 44 30 137 | 2/1996 |
| DE | 197 20 958 | 11/1998 |
| DE | 199 26 568 | 12/2000 |
| DE | 101 32 446 | 1/2003 |
| EP | 1 199 461 | 4/2002 |

* cited by examiner

*Primary Examiner*—M. McMahon
(74) *Attorney, Agent, or Firm*—Collard & Roe, P.C.

(57) ABSTRACT

The invention relates to a cooling channel covering for a piston of an internal combustion engine in the form of a spring metal sheet which is measured in such a manner that wear and tear in the region of the surface is prevented, in such a manner that a peripheral gap is produced between the radial, external front side of the spring metal sheet and the radial, external limit of the step-shaped recess.

2 Claims, 4 Drawing Sheets

(State of the Art)

COOLING CHANNEL COVER FOR A PISTON OF AN INTERNAL COMBUSTION ENGINE

CROSS REFERENCE TO RELATED APPLICATIONS

Figure 1:
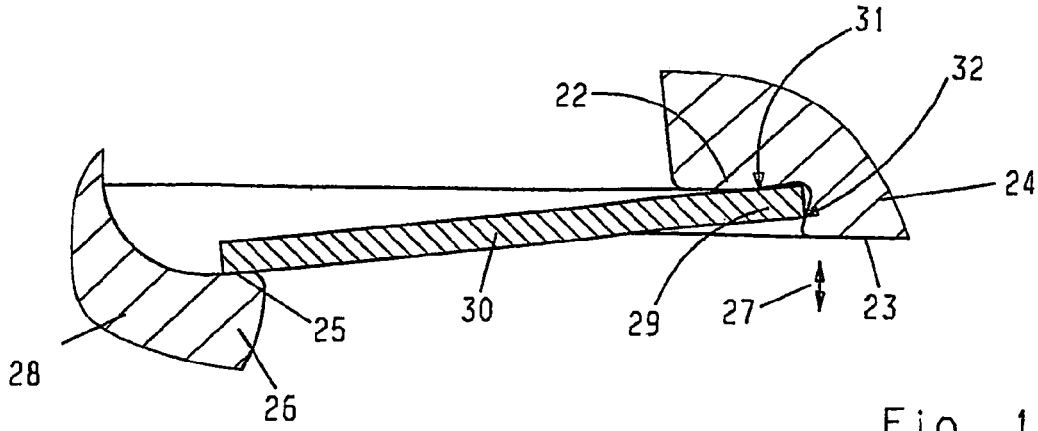

Applicant claims priority under 35 U.S.C. §119 of German Application No. 10 2004 019 011.9 filed Apr. 20, 2004. Applicant also claims priority under 35 U.S.C. §365 of PCT/DE2005/000717 filed Apr. 19, 2005. The international application under PCT article 21(2) was not published in English.

The invention relates to a cooling channel cover for a piston of an internal combustion engine, in accordance with the preamble of claim 1.

It is known from the patent document DE 42 08 037 to provide a piston for an internal combustion engine with a cooling channel that lies radially on the outside and is open towards the piston skirt, in the region of the piston crown. To improve the cooling effect of the cooling oil that is introduced into the cooling channel, the cooling channel is closed off by means of a cooling channel cover, in which there are openings for conducting the cooling oil in and out. It is also known to give the cooling channel cover the shape of a two-part plate spring, which (see FIG. 1 in this regard) on its outer edge 29 is attached in a recess 22 in the face side 23 of a ring wall 24 that ends in open manner, as an outer pedestal, and on its inner edge is attached on a circumferential step 26, which is affixed to the ring rib as an inner pedestal 25, under axial bias.

In this connection, however, relative movements of the ring wall 24 relative to the piston base body 28 occur, as indicated by the arrow 27, during engine operation, because of the pressure of the combustion gases on the piston, but also because of the mass forces that act on the ring wall 24 due to the back and forth movements of the piston. This also results in relative movements of the plate spring, particularly relative to the ring wall 24, in the region of the contact points 31 and 32, and this leads to damage both of the plate spring 30 and of the recess 22 in this region.

Another disadvantage of the cooling cover known from the state of the art, consisting of two plate spring halves in semicircular shape, consists in the fact that forces that are directed both axially and radially are exerted on the ring wall 24 by this. These forces are maximal at the abutting ends of the plate spring halves, so that the axial forces in this region lead to a non-sine-shaped deformation of the piston ring grooves in this region, which the piston rings accommodated in them cannot follow, thereby increasing the oil consumption of an internal combustion engine equipped with the piston in question, in particular. The radially directed forces, which are maximal at the abutting ends of the plate spring halves, result in an oval deformation, in cross-section, of the ring wall 24 here, bringing with it the risk of piston scoring.

Proceeding from this, the invention is based on the problem of avoiding the aforementioned disadvantages of the state of the art.

The problem is solved with the characteristics indicated in the characterizing part of the main claim. A practical embodiment of the invention is the subject of the dependent claim.

Figure 2:
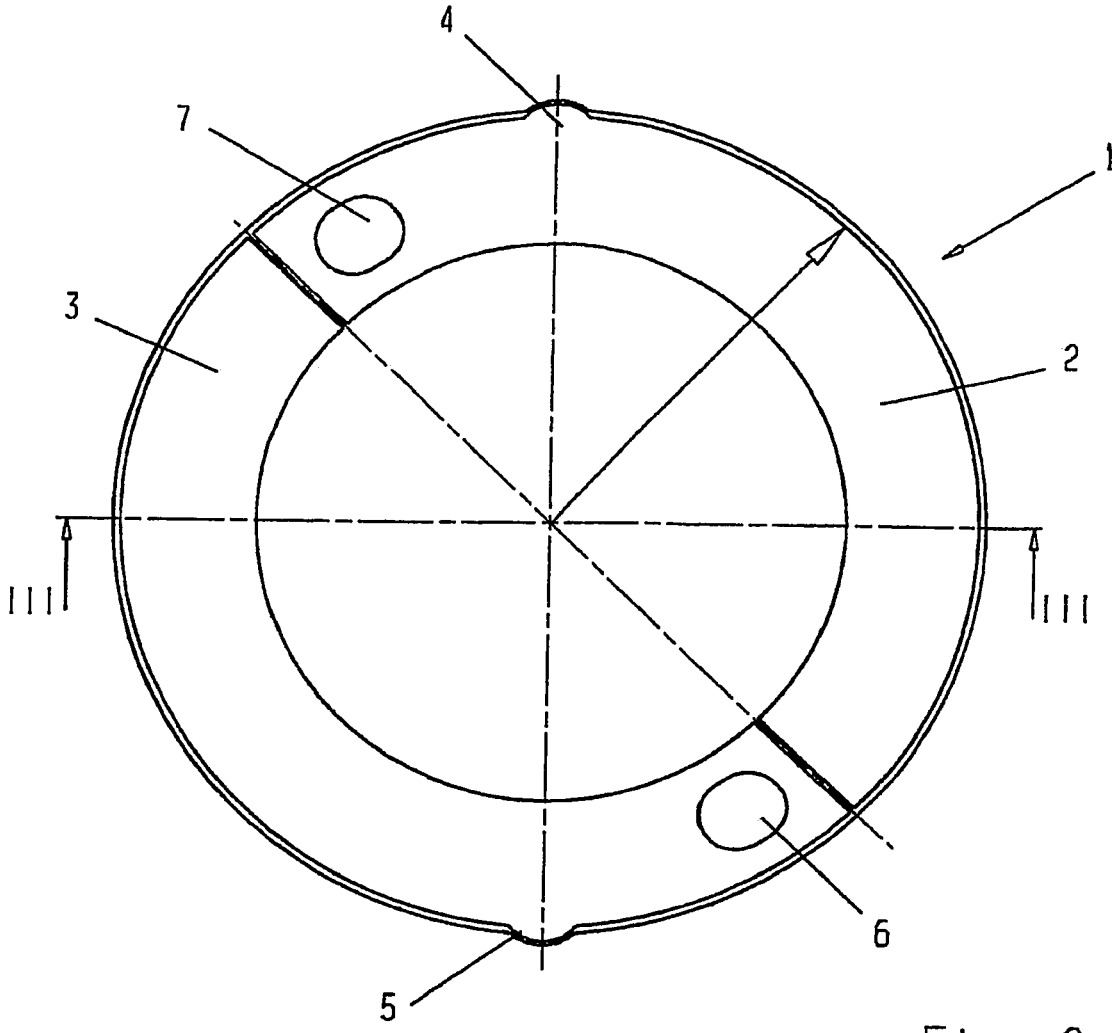
Figure 3:
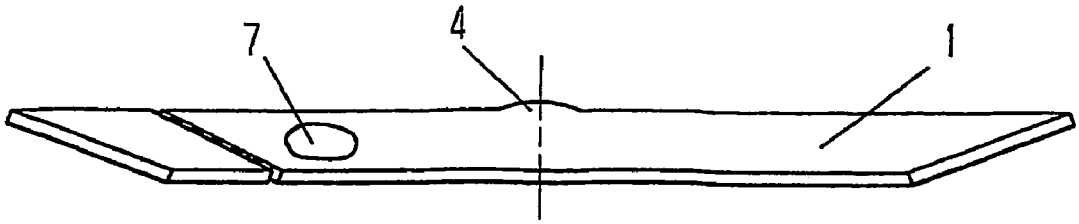
Figure 4:
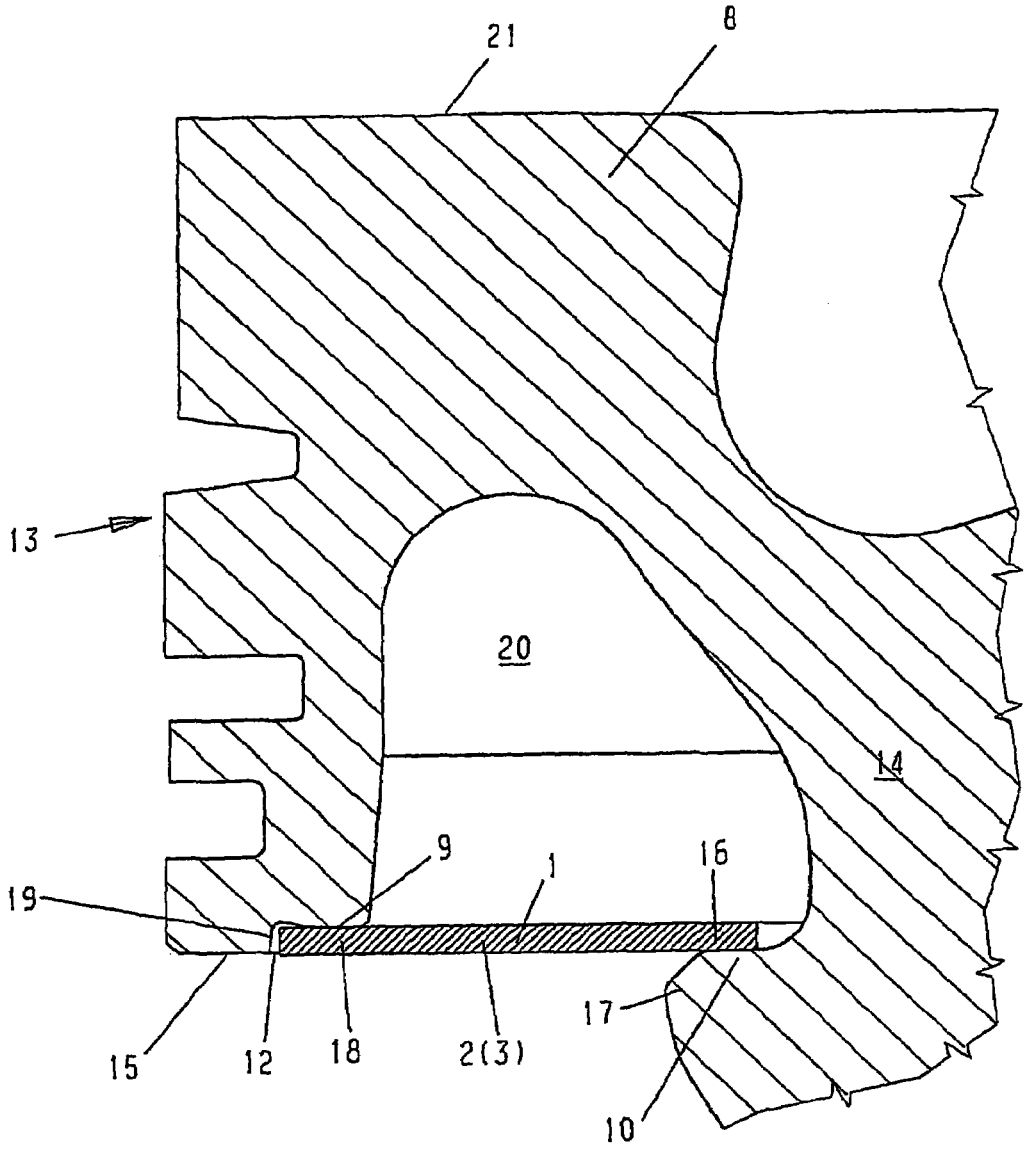

The invention will be described below, using the drawings. These show:

FIG. 1 a spring metal sheet in accordance with the state of the art, for closing off the cooling channel of a piston for an internal combustion engine, in section, FIG. 2 a spring metal sheet in accordance with the present invention in a top view, FIG. 3 the spring metal sheet according to the invention in section along the line III-III in FIG. 2, and FIG. 4 the spring metal sheet according to the invention.

FIGS. 2 and 4 show a ring-shaped spring metal sheet 1 for closing off the cooling channel 20 of a piston 8 for an internal combustion engine, which consists of two spring metal sheet halves 2 and 3 having a semicircular shape. Each of the two spring metal sheet halves 2, 3 has a formed-on part 4 and 5, the purpose of which consists in securing the spring metal sheet 1 that is built into the piston 8 against rotation. Furthermore, each of the spring metal sheet halves 2, 3 is provided with an opening 6 and 7, in order to conduct oil into and out of the cooling channel.

FIG. 3 shows a section through the spring metal sheet 1 along the line III-III in FIG. 2. The formed-on part 4 and the opening 7 can be seen. In particular, it becomes clear that the spring metal sheet 1 has the shape of a flat funnel in the relaxed state.

In FIG. 4, the spring metal sheet 1 is shown after having been installed into the piston 8. It can be seen that the spring metal sheet 1 has a level position here, i.e. that it has experienced torsion as compared with the funnel-shaped position shown in FIG. 3. The torsion tension produced in the spring metal sheet 1 by this has the effect that its radially inner edge region 16 rests on the top of a projection 17 of the piston base body 14 on the piston crown side, forming a first support 10, and its radially outer edge region 18 rests on a second support 9 formed by a step-shaped recess 19 of the underside 15 of the ring belt 13, facing away from the piston crown, under bias, and that the spring metal sheet 1 is fixed in place in the piston 8.

The spring metal sheet 1 has an outside radius 11 (FIG. 2) that is dimensioned in such a manner that a gap 12 forms (FIG. 4) between spring metal sheet 1 and piston 8. In this way, the result is achieved that in the case of relative movements between the piston 8 and the spring metal sheet 1, damage to the spring metal sheet 1 and to the piston 8 is avoided in the region of the gap 12.

Furthermore, the surfaces of the supports 9 and 10 are so great that minimal wear occurs here in the case of relative movements between piston 8 and spring metal sheet 1.

These relative movements are the result both of the combustion pressure acting on the piston 8 and of the mass forces that act on the ring belt 13 in the case of higher speeds of rotation, thereby bringing about the result that the ring belt 13 moves relative to the piston base body 14, leading to relative movements of the spring metal sheet 1 both relative to the ring belt 13 and relative to the piston base body 14.

During assembly, the two spring metal sheet halves 2 and 3 are laid against the underside 15 of the ring belt 13, facing away from the piston crown, exposed to an axial force that acts in the direction of the piston crown 21 on their radial inside, and thereby put into torsion to such an extent that the radially inner edge region 16 of the spring metal sheet halves 2, 3 comes to lie above the first support 10. Afterwards, the spring metal sheet halves 2, 3 are pushed into their position as shown in FIG. 4 by means of a force that is directed radially inwards.

REFERENCE SYMBOLS

1 spring metal sheet
2, 3 spring metal sheet half
4, 5 formed-on part
6, 7 opening
8 piston
9 second support
10 first support
11 outside radius

12 gap
13 ring belt
14 piston base body
15 underside of the ring belt 13
16 radially inner edge region of the spring metal sheet 1
17 projection
18 radially outer edge region of the spring metal sheet 1
19 step-shaped recess
20 cooling channel
21 piston crown
22 recess
23 face side of the ring wall 24
24 ring wall
25 inner pedestal
26 stepped part
27 arrow
28 piston base body
29 outer edge of the plate spring 30
30 plate spring
31, 32 contact point

The invention claimed is:

1. Cooling channel cover for a cooling channel (20) lying radially on the outside in the region of the crown (21) of a piston (8) of an internal combustion engine and open towards the underside facing away from the piston crown, whereby the cooling channel cover has the shape of a ring-shaped spring metal sheet (1) consisting of two semi-circular halves (2, 3), the radially inside edge region (16) of which sheet lies on a first support (10), which is formed by the top of a projection (17) of the piston base body (14) that is directed radially outward and delimits the cooling channel (20) radially on the inside, and the radially outside edge region (18) of which sheet lies on a second support (9) formed by a step-shaped recess (19) of the underside (15) of the ring belt (13) of the piston (8), which delimits the cooling channel (20) radially on the outside, wherein the outside radius (11) of the spring metal sheet (1) is dimensioned in such a manner that a circumferential gap (12) forms between the radially outer face side of the spring metal sheet (1) and the radial delimitation of the step-shaped recess (19), and that the second support (9) is disposed closer to the piston crown (21) by at least approximately the thickness of the spring metal sheet (1) than the first support (10), so that after installation in the piston (8), the spring metal sheet (1) assumes an at least approximately level position.

2. Cooling channel cover for a cooling channel (20) according to claim 1, wherein the two spring metal sheet halves (2, 3) have at least one formed-on part (4, 5) directed radially outward.

* * * * *